US006098211A

United States Patent [19]

Ehrensperger et al.

[11] Patent Number: 6,098,211

[45] Date of Patent: Aug. 8, 2000

[54] TRIGGERING OF A CLEANING, VENTILATION AND/OR DISINFECTION PROCESS

[75] Inventors: Markus Ehrensperger, Hettlingen; Hans-Peter Meier, Regensberg, both of Switzerland

[73] Assignee: CWS International AG, Baar, Switzerland

[21] Appl. No.: 09/242,182

[22] PCT Filed: Aug. 16, 1996

[86] PCT No.: PCT/CH96/00284

§ 371 Date: Feb. 2, 1998

§ 102(e) Date: Feb. 2, 1998

[87] PCT Pub. No.: WO98/07930

PCT Pub. Date: Feb. 26, 1998

[51] Int. Cl.[7] ..... A47K 13/00

[52] U.S. Cl. ..... 4/233; 4/DIG. 3

[58] Field of Search ..... 4/302, 305, 313, 4/406, 623, 668, DIG. 3, 233

[56] References Cited

U.S. PATENT DOCUMENTS

| | | | |
|---|---|---|---|
| 4,651,777 | 3/1987 | Hardman | 4/DIG. 3 |
| 5,251,340 | 10/1993 | Su-Land | 4/304 |

FOREIGN PATENT DOCUMENTS

| | | |
|---|---|---|
| 3514640 | 10/1986 | Germany . |
| 2190112 | 11/1987 | United Kingdom . |
| 8501560 | 4/1985 | WIPO . |

*Primary Examiner*—Charles E. Phillips
*Attorney, Agent, or Firm*—Schweitzer Cornman Gross & Bondell LLP

[57] ABSTRACT

This invention concerns a process for actuating a physical/technical process, particularly in toilette facilities, which employs a sound sensor (M) with signal analysis which is located in close proximity to a liquid inlet (8). In a device for automatic cleaning of toilette seats (4), the sensor (M) is built in next to the flushing water inlet. The flushing noises are selected using a signal analysis circuit and cleaning of the seat (4) and evacuation of odors (G) via a ventilator (15) is only triggered if the flushing process has been clearly detected.

12 Claims, 4 Drawing Sheets

TRIGGERING OF A CLEANING, VENTILATION AND/OR DISINFECTION PROCESS

The present invention relates to a method for triggering a cleaning, ventilating, disinfecting or deodorizing process, as well as to an apparatus carrying out the method and to applications of the method.

BACKGROUND OF THE INVENTION

A self-cleaning toilet is known from the firm CWS International AG, Baar, having a toilet seat which rotates after actuation of water flushing system. In one version, the rotation is triggered by an electrical contact (microswitch; infrared sensor) connected to the actuating lever of the flushing tern. In the second version, the inflowing flushing water, or water mains system, drives a turbine which sets in motion, a generator, the drive motors for the cleaning and infection of the toilet seat.

Generally, the known arrangements have proved successful in practice. However, it has been found that problems relating to as of responsibility and competence in respect of tallation and maintenance arise, since the installation cannot be dealt with by the ordinary sanitary fitter. In addition, the fact that the control and drive unit of the apparatus is connected to the flushing cistern brings further advantages owing to the highly specific nature of the arrangement, such as unintentionally initiated operations, as well as a system-related susceptibility to faults.

Generic methods and devices are published in WO85/01560, in which there is arranged in close proximity to a water outlet, e.g. a shower, an acoustic sensor which, initiated by an acoustic signal, activates a solenoid valve and thus controls the water flow in a contactless manner. The resultant signal voltage is adjusted in an amplifier circuit and at a rectifier bridge using a so-called differentiating network and allows only a rudimentary adaptation to the local circumstances. This device is thus restricted to individual applications, as a plurality of water outlets equipped in the same way and located one beside the other would undergo mutual initiation and activation. Also, the reliability of the signal detection is inadequate and not sufficiently reproducible for numerous applications.

It is therefore the object of the invention to trigger a physical/technical procedure only when this is intended by the user or operator of the installation. Instances of triggering due to incomplete flushing and/or inflow procedures are also to be eliminated; the procedure to be triggered must take place in an operationally reliable manner. A plurality of adjacent inflow and/or flushing procedures must also be possible without these influencing one another.

Furthermore, the need for intervention in the rest of the apparatus region is to be obviated; the responsibility of the installation and maintenance staff must be able to be clearly laid down, without tasks which are foreign to their trade being assigned to them.

The subject of the invention is to allow further damp-room-related applications over and above the direct toilet use.

BRIEF DESCRIPTION OF THE INVENTION

This object is achieved by the method of the present invention wherein an acoustic sensor is arranged in close proximity to a flushing or inflow of a liquid. The output of the sensor activates a desired device. The location of the acoustic sensor in close proximity to the inflow of a liquid causes a first, spatial and selective differentiation in the event of a plurality of identical or similar sound sources being present. The method results in an improved differentiation of the triggering sound source from interfering sources which may be present.

The dimensioning of the filter and thus the method can be optimized by a spectral analysis.

The method of the invention may include a calibration step utilizing sequential signal values to derive an average for reference.

After the calibration, the activation of the physical/technical device can be reproducibly realized. In particular, this allows incomplete flushing and/or inflow procedures to be detected. Other inflow procedures which occur during use are also reliably detected as such, that is to say the device cannot be unintentionally activated.

A band filtering in accordance with the apparatus is particularly suitable for monitoring the flushing inflow into a toilet bowl. An active band filter in the range of 8+/−1 kHz can be realized outstandingly well and economically.

The use of an electret microphone is also particularly advantageous owing to its selective reception characteristic and its robust design.

The invention may be employed in connection with cleaning and disinfection of a toilet seat, and prevents triggering of a cleaning procedure on the toilet seat at the wrong time. In addition, there results the great practical advantage of the cleaning and disinfection being completely independent of the rest of the sanitary installation and thus of a clear separation of fields, between sanitary fitter and equipment supplier or equipment technician, in respect of the fitting and also maintenance of the devices being ensured.

The control of an extractor in a toilet and/or in the toilet room allows ventilation which is favourable in terms of energy, and prevents unpleasant draughts.

Deodorant procedures can also be triggered when these are necessary, i.e. instances of inappropriate and material-consuming regular triggering associated with ordinary door actuations can be eliminated.

Applications can be used to reduce the water consumption; moreover, they allow the inclusion of further cleaning procedures associated with the use, for example, of a public toilet.

Devices which are additionally present can also be disabled. and/or activated in order to allow, for example, their use only in conjunction with a controlled toilet use.

BRIEF DESCRIPTION OF THE DRAWINGS

Exemplary embodiments of the subject of the invention are described in more detail below with reference to drawings, in which.

DETAILED DESCRIPTION OF THE INVENTION

Figure 1:
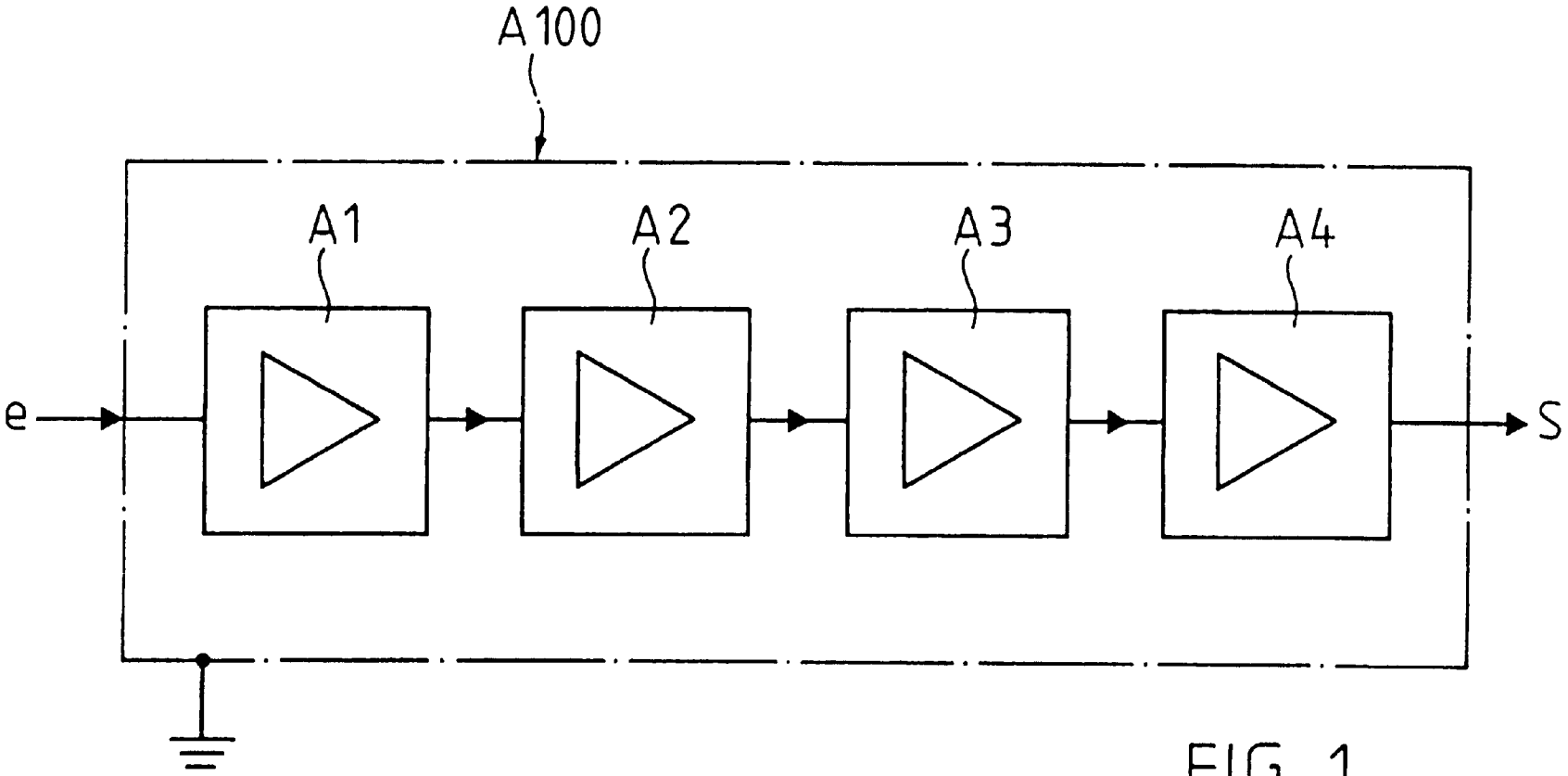
FIG. 1 shows a block diagram of an electronic circuit for carrying out the method.

The present invention relates to a method for triggering a cleaning, ventilating, disinfecting or deodorizing process as well as to an apparatus for carrying out the method and to applications of the method.

BACKGROUND OF THE INVENTION

A self-cleaning toilet is known from the firm CWS International AG, Baar, having a toilet seat which rotates after actuation of the water flushing system. In one version, the rotation is triggered by an electrical contact (microswitch; infrared sensor) connected to the actuating lever of the flushing cistern. In the second version, the inflowing flushing water, or the water mains system, drives a turbine which sets in motion, via a generator, the drive motors for the cleaning and disinfection of the toilet seat.

Generally, the known arrangements have proved successful in practice. However, it has been found that problems relating to areas of responsibility and competence in respect of installation and maintenance arise, since the installation cannot be dealt with by the ordinary sanitary fitter. In addition, the fact that the control and drive unit of the apparatus is connected to the flushing cistern brings further disadvantages owing to the highly specific nature of the arrangement, such as unintentionally initiated operations, as well as a system-related susceptibility to faults.

Generic methods and devices are published in WO85/01560, in which there is arranged in close proximity to a water outlet, e.g. a shower, an acoustic sensor which, initiated by an acoustic signal, activates a solenoid valve and thus controls the water flow in a contactless manner. The resultant signal voltage is adjusted in an amplifier circuit and at a rectifier bridge using a so-called differentiating network and allows only a rudimentary adaptation to the local circumstances. This device is thus restricted to individual applications, as a plurality of water outlets equipped in the same way and located one beside the other would undergo mutual initiation and activation. Also, the reliability of the signal detection is inadequate and not sufficiently reproducible for numerous applications.

It is therefore the object of the invention to trigger a physical/technical procedure only when this is intended by the user or operator of the installation. Instances of triggering due to incomplete flushing and/or inflow procedures are also to be eliminated; the procedure to be triggered must take place in an operationally reliable manner. A plurality of adjacent inflow and/or flushing procedures must also be possible without these influencing one another.

Furthermore, the need for intervention in the rest of the apparatus region is to be obviated; the responsibility of the installation and maintenance staff must be able to be clearly laid down, without tasks which are foreign to their trade being assigned to them.

The subject of the invention is to allow further damp-room-related applications over and above the direct toilet use.

BRIEF DESCRIPTION OF THE INVENTION

This object is achieved by the method of the present invention wherein an acoustic sensor is arranged in close proximity to a flushing or inflow of a liquid. The output of the sensor activated a design device. The location of the acoustic sensor in close proximity to the inflow of a liquid causes a first, spatial and selective differentiation in the event of a plurality of identical or similar sound sources being present. The method results in an improved differentiation of the triggering sound source from interfering sources which may be present.

The dimensioning of the filter and thus the method can be optimized by a spectral analysis.

The method of the invention may included a calibration step utilizing sequential signal values to derive an average for reference. After the calibration, the activation of the physical/technical device can be reproducibly realized.

The control of an extractor in a toilet and/or in the toilet room allows ventilation which is favourable in terms of energy, and prevents unpleasant draughts.

Deodorant procedures can also be triggered when these are necessary, i.e. instances of inappropriate and material-consuming regular triggering associated with ordinary door actuations can be eliminated.

Applications can be used to reduce the water consumption; moreover, they allow the inclusion of further cleaning procedures associated with the use, for example, of a public toilet.

Devices which are additionally present can also be disabled and/or activated in order to allow, for example, their use only in conjunction with a controlled toilet use.

BRIEF DESCRIPTION OF THE DRAWINGS

Exemplary embodiments of the subject of the invention are described in more detail below with reference to drawings, in which:

FIG. 1 shows a block digram of an electronic circuit for carrying out the method;

In particular, this allows incomplete flushing and/or inflow procedures to be detected. Other inflow procedures which occur during use are also reliably detected as such, that is to say the device cannot be unintentionally activated.

A band filtering in accordance with the apparatus is particularly suitable for monitoring the flushing inflow into a toilet bowl. An active band filter can be realized outstandingly well and economically.

The use of an electret microphone is also particularly advantageous owing to its selective reception characteristic and its robust design.

The invention may be employed in connection with cleaning and disinfection of a toilet seat, and prevents triggering of a cleaning procedure on a toilet seat at the wrong time. In addition, there results the great practical advantage of the cleaning and disinfection being completely independent of the rest of the sanitary installation and thus of a clear separation of fields, between sanitary fitter and equipment supplier or equipment technician, in respect of the fitting and also maintenance of the devices being ensured.

Figure 2:
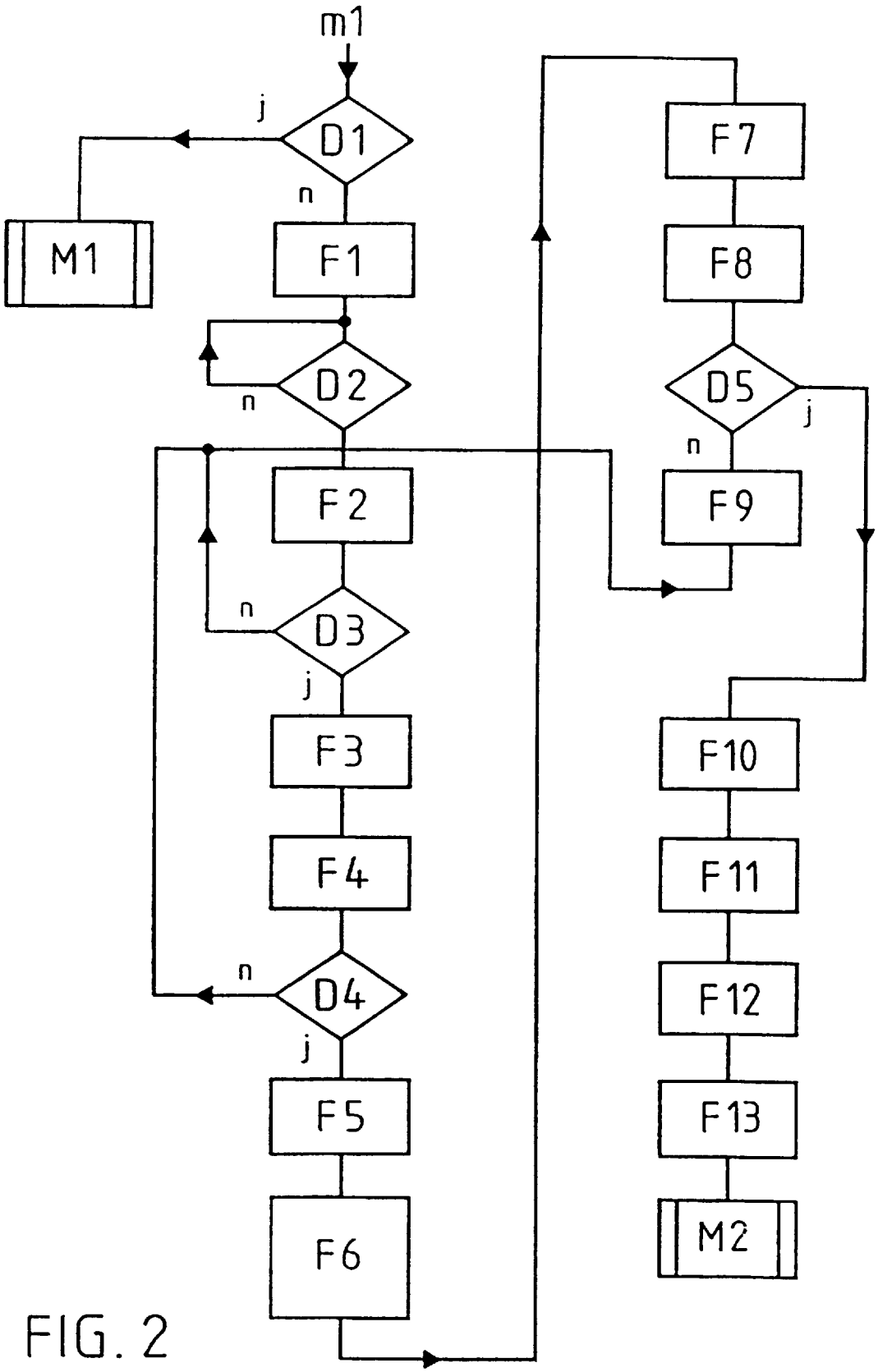
FIG. 2 shows the flow diagram relating to a program which allows calibration and adaptation of the acoustic sensor and the evaluation circuit to the characteristic of the sound source.
Figure 3:
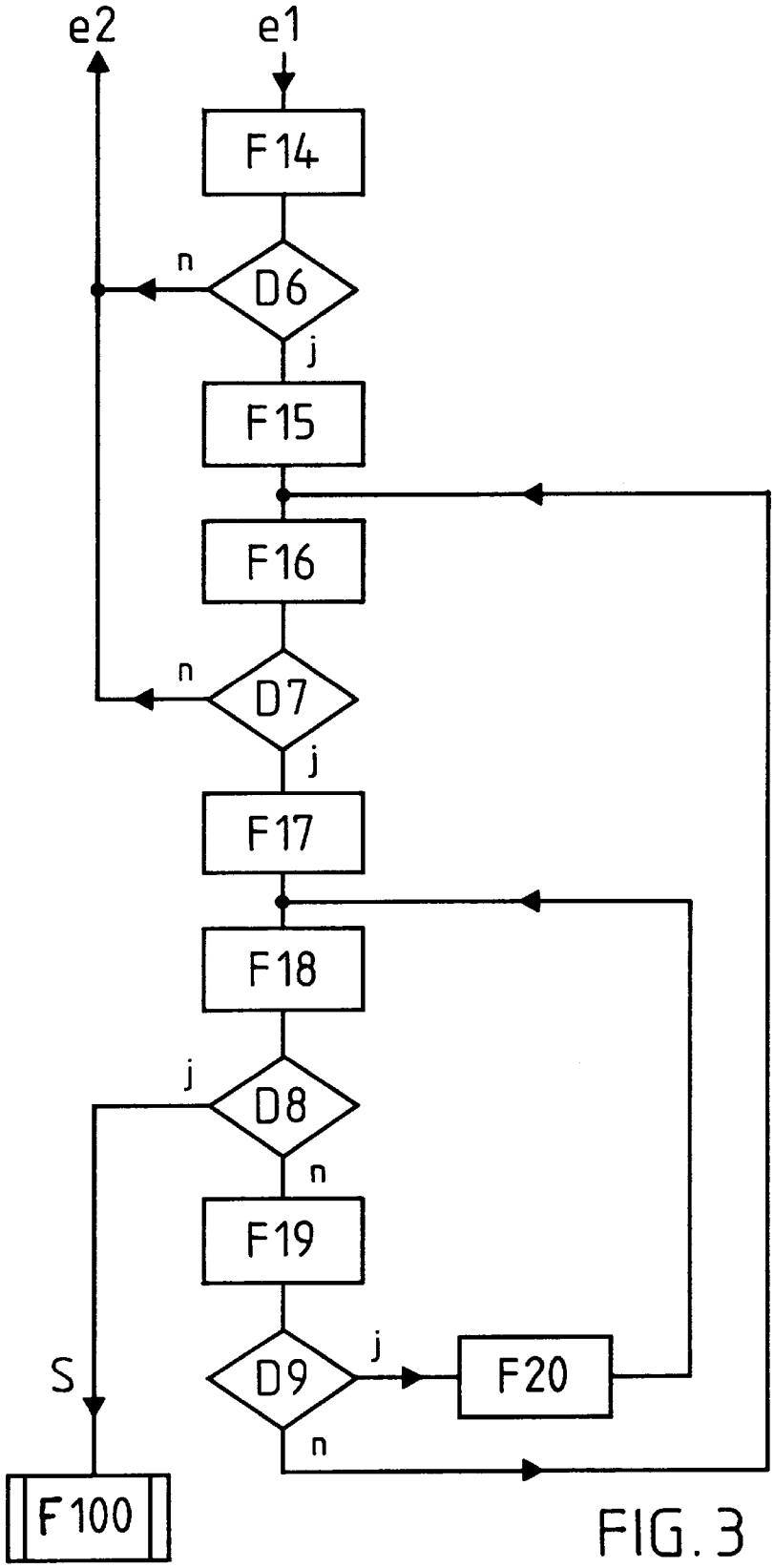
FIG. 3 shows the signal detection sequence for triggering a proper toilet seat cleaning cycle.
Figure 4:
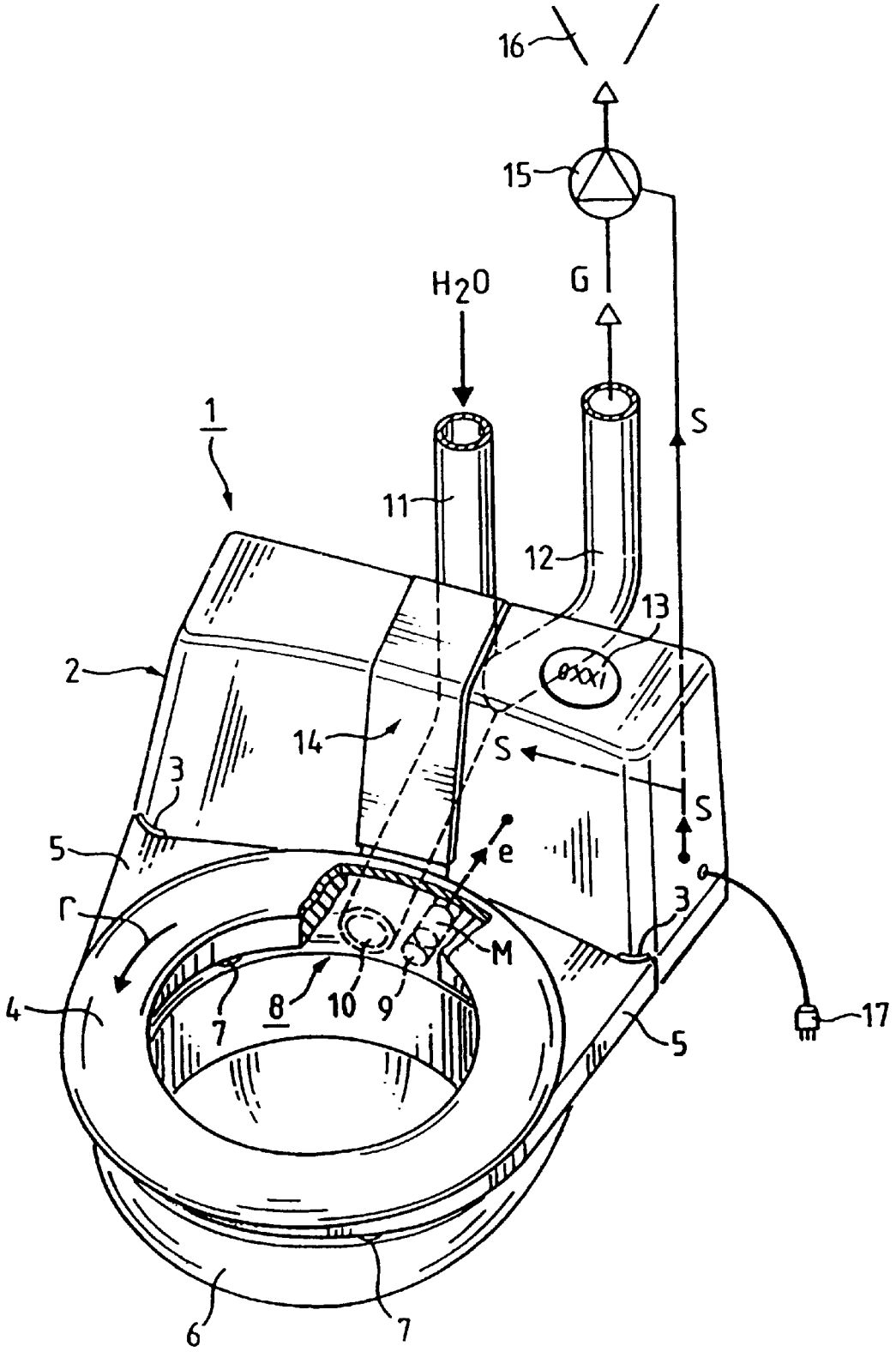
FIG. 4 shows a simplified representation of a toilet with cleaning and disinfecting apparatus and a targeted extraction of unpleasant odours at the place where they arise.

FIG. 2 shows the flow diagram relating to a program which allows calibration and adaptation of the acoustic sensor and the evaluation circuit to the characteristic of the sound source;

FIG. 3 shows the signal detection sequence for triggering a proper toilet seat cleaning cycle; and FIG. 4 shows a simplified representation of a toilet with cleaning and disinfecting apparatus and a targeted extraction of unpleasant odours at the place where they arise.

DETAILED DESCRIPTION OF THE INVENTION

In FIG. 1 a commercially available quad amplifier is denoted by A100. This amplifier comprises series-connected operational amplifiers A1 to A4 which are operated or fed back in the customary fashion according to their function.

The series of amplifiers thus comprises a single four-stage wide-band operational amplifier A100; one of the type LM 837N (National Semiconductors, USA) has proved successful.

This operational amplifier A100 is fed an input signal e, the frequency-selective output signal from an acoustic sensor; the amplified and demodulated control signal is denoted by S. The characteristic earthing of the amplifier A100 is necessary for electrical and safety reasons.

What is claimed is:

1. A method for triggering a cleaning, ventilating, disinfecting and/or deodorizing procedure in washrooms and/or toilet rooms by means of an acoustic sensor arranged in close proximity to a flushing and/or inflow procedure of a liquid and having an adjustable signal amplifier and a filter, characterized in that a frequency band filter connected upstream of the signal amplifier is tuned to a characteristic spectral range of the triggering procedure in which sound frequencies with the maximum energy lie.

2. A method according to claim 1, characterized in that the flushing and/or inflow procedure is repeated at least twice and in that an output signal emitted by the acoustic sensor is checked after amplification for a signal level which it is expected to have, and in that an average value is determined from a plurality of sequential measurements for a same flushing and/or inflow procedure, which average value is stored, together with an average value of at least one further flushing and/or inflow procedure, as a sum average value in a non-volatile, electronic memory as a base setting.

3. A method according to claim 2, characterized in that the output signal emitted by the acoustic sensor is repeatedly fed, after its analysis and after a time delay, to a comparator circuit which compares the output signal with a preset signal value, in that a duration of the output signal is checked and in that if the duration exceeds a preset value is a controlled device activated.

4. Apparatus for carrying out the method for triggering a cleaning, ventilating, disinfecting and/or deodorizing procedure in washrooms and/or toilet rooms, by means of an acoustic sensor arranged in close proximity to a flushing and/or inflow procedure of a liquid and having an adjustable signal amplifier and a filter, according to one of claims 1 to 3, characterized in that the acoustic sensor is arranged in a toilet bowl proximate the flushing inflow and in that the useful signal for activating the controlled device lies in the range from 8 kHz+/−1 kHz and has a half-width value of less than 1 kHz.

5. Apparatus according to claim 4, characterized in that a 2nd order active band filter is connected downstream to the acoustic sensor.

6. Apparatus according to claim 4, characterized in that four operational amplifiers are connected downstream to the acoustic sensor the first operational amplifier having a signal amplification of at least a factor of 50, the second operational amplifier having a signal amplification of at least a factor of 5 and being operated as a band filter, in that the third operational amplifier is a demodulator, and in that the fourth operational amplifier is operated as a current amplifier to obtain a switching signal.

7. Apparatus according to claim 4, characterized in that the acoustic sensor is an electret microphone.

8. The method according to claim 1, claim 2 or claim 3, characterized in that the device to be activated is an apparatus for cleaning and disinfecting a toilet seat.

9. The method according to claim 1, claim 2, or claim 3, characterized in that the device to be activated is an extractor in the toilet and/or in the toilet room.

10. The method according to claim 1, claim 2 or claim 3, characterized in that the device to be activated is a spraying and/or evaporating apparatus for disinfecting and/or deodorizing a toilet room.

11. The method according to claim 1, claim 2, or claim 3, characterized in that the device to be activated is an electromechanical water valve of a flushing system or of a urinal or which is in connection with a toilet.

12. The method according to claim 1, claim 2 or claim 3, characterized in that the device to be activated is an electromechanical relay which enables further devices for use.

* * * * *